US009598987B2

(12) United States Patent
Bayrakdar

(10) Patent No.: US 9,598,987 B2
(45) **Date of Patent: *Mar. 21, 2017**

(54) CAMSHAFT ADJUSTING DEVICE AND CENTRAL VALVE FOR A CAMSHAFT ADJUSTING DEVICE

(71) Applicant: Schaeffler Technologies AG & Co. KG, Herzogenaurach (DE)

(72) Inventor: Ali Bayrakdar, Rothenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/443,488

(22) PCT Filed: Oct. 28, 2013

(86) PCT No.: PCT/DE2013/200257

§ 371 (c)(1),
(2) Date: May 18, 2015

(87) PCT Pub. No.: WO2014/082630

PCT Pub. Date: Jun. 5, 2014

(65) Prior Publication Data

US 2015/0300212 A1 Oct. 22, 2015

(30) Foreign Application Priority Data

Nov. 28, 2012 (DE) ..... 10 2012 221 720

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01); *F01L 2001/34433* (2013.01); *F01L 2001/34453* (2013.01)

(58) Field of Classification Search
CPC ..... F01L 1/3442; F01L 2001/34426; F01L 2001/34423; F01L 2001/34453
(Continued)

(56) References Cited

U.S. PATENT DOCUMENTS 5,343,834 A 9/1994 Rembold et al.
7,261,072 B2 * 8/2007 Schmitt ..... F01L 1/3442 123/90.12

(Continued)

FOREIGN PATENT DOCUMENTS

DE 4116152 A1 11/1992
DE 102008005766 A1 7/2009

(Continued)

*Primary Examiner* — Ching Chang
(74) *Attorney, Agent, or Firm* — Volpe and Koenig, P.C.

(57) ABSTRACT

A camshaft adjusting device for an internal combustion engine including: a rotor that can be rotationally fixed to a camshaft of the internal combustion engine; a pot-shaped stator that encompasses the rotor and can be driven by a crankshaft; and an annular chamber situated between the stator and the rotor and subdivided into multiple pressure chambers by stator ribs that are located on the stator and that extend up to the rotor. Each pressure chamber is subdivided into two working chambers (A,B) by vanes provided on the rotor. The device also includes a central valve (1) which has a displaceable valve body (2), by which a pressure medium that is fed via a pressure medium pump (P) from a pressure medium reservoir (T) can be selectively introduced into the working chambers (A,B) on one side of the vanes and can be fed back from the working chambers (A,B) on the other side of the vanes to the pressure medium reservoir (T), depending on a position of the valve body (2). A pressure limiting valve (15) is provided in the camshaft adjusting device, said valve allowing the pressure medium to be fed back to the pressure medium reservoir (T), or to the pressure (Continued)

medium pump (P), if a predefined pressure is exceeded in the camshaft adjusting device.

8 Claims, 2 Drawing Sheets

(58) Field of Classification Search
USPC ..... 123/90.15, 90.17
See application file for complete search history.

(56) References Cited

U.S. PATENT DOCUMENTS

| | | | |
|---|---|---|---|
| 2002/0124819 | A1 | 9/2002 | Lunsford |
| 2005/0045142 | A1 | 3/2005 | Rozario et al. |
| 2005/0061290 | A1 | 3/2005 | Plenzler et al. |
| 2012/0111296 | A1 | 5/2012 | Hoppe et al. |
| 2013/0112163 | A1 | 5/2013 | Bayrakdar |
| 2013/0199471 | A1 | 8/2013 | Schafer et al. |

FOREIGN PATENT DOCUMENTS

| | | | |
|---|---|---|---|
| DE | 102009031701 | | 1/2011 |
| DE | 102010026853 | A1 | 1/2012 |
| DE | 102010060181 | | 4/2012 |
| DE | 102010050813 | | 5/2012 |
| DE | 202011108497 | U1 | 3/2013 |
| DE | 102012201558 | A1 | 8/2013 |
| WO | 2009092491 | A2 | 7/2009 |

* cited by examiner

A
B
P
T
F

CAMSHAFT ADJUSTING DEVICE AND CENTRAL VALVE FOR A CAMSHAFT ADJUSTING DEVICE

BACKGROUND

The invention relates to a camshaft adjusting device and to a central valve for a camshaft adjusting device.

Camshaft adjusting devices are generally used in valve trains of internal combustion engines to change the valve opening and closing times, which can improve the consumption values for the internal combustion engine and the performance characteristics in general.

An embodiment of the camshaft adjusting device that has proven effective in practice has a vane cell adjuster with a stator and a rotor that define an annular space divided by projections and vanes into several work chambers. The work chambers can be loaded selectively with a pressurized medium that is fed in a pressurized medium circuit via a pressurized medium pump from a pressurized medium reservoir into the work chambers on one side of the vanes of the rotor and is fed back into the pressurized medium reservoir from the work chambers on the other side of the vanes. The control of the pressurized medium flow and thus the adjustment movement of the camshaft adjusting device is realized, e.g., by means of a central valve with a complex structure of flow openings and control edges and a valve body that is displaceable in the central valve and closes or opens the flow openings as a function of its position. The valve body itself is spring-mounted relative to the central valve and is shifted against the spring force by means of a contacting piston of an actuator for adjusting the rotational angle of the rotor relative to the stator. The rotor is usually connected to the camshaft, while the stator is driven, e.g., by means of a chain or a belt, by a crankshaft of the internal combustion engine so that the rotational angle of the camshaft to the crankshaft is also adjusted by adjusting the rotor relative to the stator.

The camshaft adjusting device thus comprises a plurality of components with a complex structure of pressurized medium channels, openings, and control edges, which include, in particular, the central valve, the valve body, and the rotor. Due to the complex shaping and due to cost reasons, certain components, e.g., parts of the central valve, are made from plastic.

As the pressurized medium, preferably hydraulic oil is used that is heated to high temperatures up to 100 degrees when the internal combustion engine is running and is continuously cooled by the coolant circuit of the internal combustion engine. The pressurized medium is pressurized at least when the camshaft adjusting device is actuated with unavoidable pressure spikes that can lead, in extreme cases, to damage to the plastic parts, especially in connection with the higher temperatures and a resulting negative change to the strength properties of the plastic.

SUMMARY

Therefore, the objective of the invention is to create a camshaft adjusting device in which the likelihood that parts present in the camshaft adjusting device, especially plastic parts, will be damaged by pressure spikes is reduced.

To address this objective, according to the basic concepts of the invention it is provided that, in the camshaft adjusting device, a pressure limiting valve is provided that enables, when a predetermined pressure is exceeded in the camshaft adjusting device, a return of the pressurized medium into the pressurized medium reservoir or to the pressurized medium pump. Through the pressure limiting valve, the pressure of the pressurized medium in the camshaft adjusting device can be limited, in that the pressurized medium can flow into the pressurized medium reservoir or back into the feed line leading to the pressurized medium pump through the automatically opening pressure limiting valve if pressure spikes occur. In this way, the loading of the components in the camshaft adjusting device can be reduced, which is advantageous especially with respect to the service life to be expected and the susceptibility of the parts to damage, especially of plastic parts, in the camshaft adjusting device. The differential pressure at which the pressure limiting valve opens can be predetermined by the design of the pressure limiting valve, wherein, in particular, the spring mass and the spring bias of the pressure limiting valve is made available when the pressure limiting valve concerns a spring mass system.

It is further proposed, on the camshaft adjusting device, a non-return valve is provided through which the pressurized medium fed from the pressurized medium pump can be fed into the camshaft adjusting device and that the pressure limiting valve is arranged effectively parallel to the non-return valve. By means of the non-return valve, the feeding of the pressurized medium from the pressurized medium pump is enabled when a predetermined differential pressure is exceeded, while a return flow of the pressurized medium is intentionally prevented. By means of the parallel arrangement of the pressure limiting valve, the non-return valve can be practically bridged. Practically a second flow path is created by which the pressurized medium can flow past the non-return valve to the pressurized medium pump when a predetermined differential pressure is exceeded.

Such a solution can be implemented in a structurally very simple way in that the non-return valve comprises a first flow opening that can be closed by means of a first closing part against the feeding direction of the pressurized medium from the pressurized medium pump and the pressure limiting valve comprises a second flow opening that enables a return flow of the pressurized medium while bypassing the non-return valve and is closed by means of a second closing part, wherein the first and the second flow openings are arranged in a closing plate closing a feed opening in the central valve, and the first and the second closing part are each formed by a spring sheet closing the flow openings on different sides of the closing plate. The closing plate is here used as a partition wall and closing surface for the spring sheet of the non-return valve and simultaneously as a partition wall and closing surface for the spring sheet of the pressure limiting valve. In this way, the additionally provided pressure limiting valve can be implemented with very low production costs and with very low requirements for structural space, without having to structurally create an additional pressurized medium line or a separate flow path for the pressure limiting valve.

Alternatively it is proposed that the pressure limiting valve is arranged in a partition wall of the central valve or the valve body, which separates a pressurized medium line leading to the work chambers from a pressurized medium line leading to the pressurized medium reservoir. By means of the proposed arrangement of the pressure limiting valve, a direct return of the pressurized medium into the pressurized medium reservoir is enabled. The direct return of the pressurized medium into the pressurized medium reservoir is advantageous because the differential pressure applied to the pressure limiting valve is greater than for an arrangement of the pressure limiting valve in the feed line of the pressurized medium, because the pressure of the pressurized medium in the pressure reservoir for nearly all operating states of the camshaft adjusting device is lower than in the feed line of the pressurized medium from the pressurized medium pump. Due to the greater differential pressure, the pressure limiting valve can be designed with a larger biasing force, so that the likelihood that the pressure limiting valve opens unintentionally can be reduced.

It is further provided that the valve body has a pipe section that forms a section of the pressurized medium line leading to the pressurized medium reservoir and pressurized medium flowing to the work chambers flows around this section on its outer side and the pressure limiting valve is formed by an opening in the pipe section that is closed on the radial inner side of the pipe section by a ring sleeve. The ring sleeve is automatically supported on the pipe section for corresponding dimensions, so that, in the ideal case, additional measures for fastening the ring sleeve can be eliminated. The ring sleeve opens the opening by deforming inward when a predetermined differential pressure is exceeded and the pressurized medium can flow through the opening and the gap formed between the inner wall of the pipe section and the ring sleeve to the pressurized medium reservoir.

It is further provided that the pressure limiting valve is integrated through insert molding with plastic into a plastic part of the camshaft adjusting device. By means of the present solution, the pressure limiting valve can be arranged in an especially economical way in the camshaft adjusting device, because special measures or parts are no longer required for fastening the pressure limiting valve.

It is further provided that, between the valve body and the central valve, there is a spring that is supported on a base surface of the central valve and forces the valve body into a starting position and the pressure limiting valve is formed by an opening in the base surface that is closed by means of a closing plate arranged between the spring and the base surface. The spring is used for spring biasing of the valve body, so that this automatically moves back into the starting position after actuation by means of a contacting piston of an actuator. The spring is further used to ensure that the valve body is also arranged in the starting position with the smallest possible gap to the piston or even permanently contacts the piston. Due to this solution, the spring is simultaneously used for spring loading the pressure limiting valve in addition to the spring loading of the valve body, which further simplifies the structural design. The only complication for creating the pressure limiting valve consists in providing a flow opening in the base surface, wherein this flow opening is then closed by the closing plate arranged between the spring and the base surface.

To address this objective, a central valve for a camshaft adjusting device with the features of the preamble is also provided, in which, in the central valve, a pressure limiting valve is provided that enables a return of the pressurized medium into the pressurized medium reservoir or to the pressurized medium pump when a predetermined pressure in the pressurized medium is exceeded. The pressure limiting valve is, in this case, integrated in the central valve and installed together with this central valve in the camshaft adjusting device, so that the additional function of limiting the pressure is possible without structurally changing the camshaft adjusting device.

BRIEF DESCRIPTION OF THE DRAWINGS

The invention is explained in more detail below using a preferred embodiment. Shown in the figures in detail are.

DETAILED DESCRIPTION OF THE PREFERRED EMBODIMENTS

Figures 1, 2, 3, 4, 5, 6, 7:
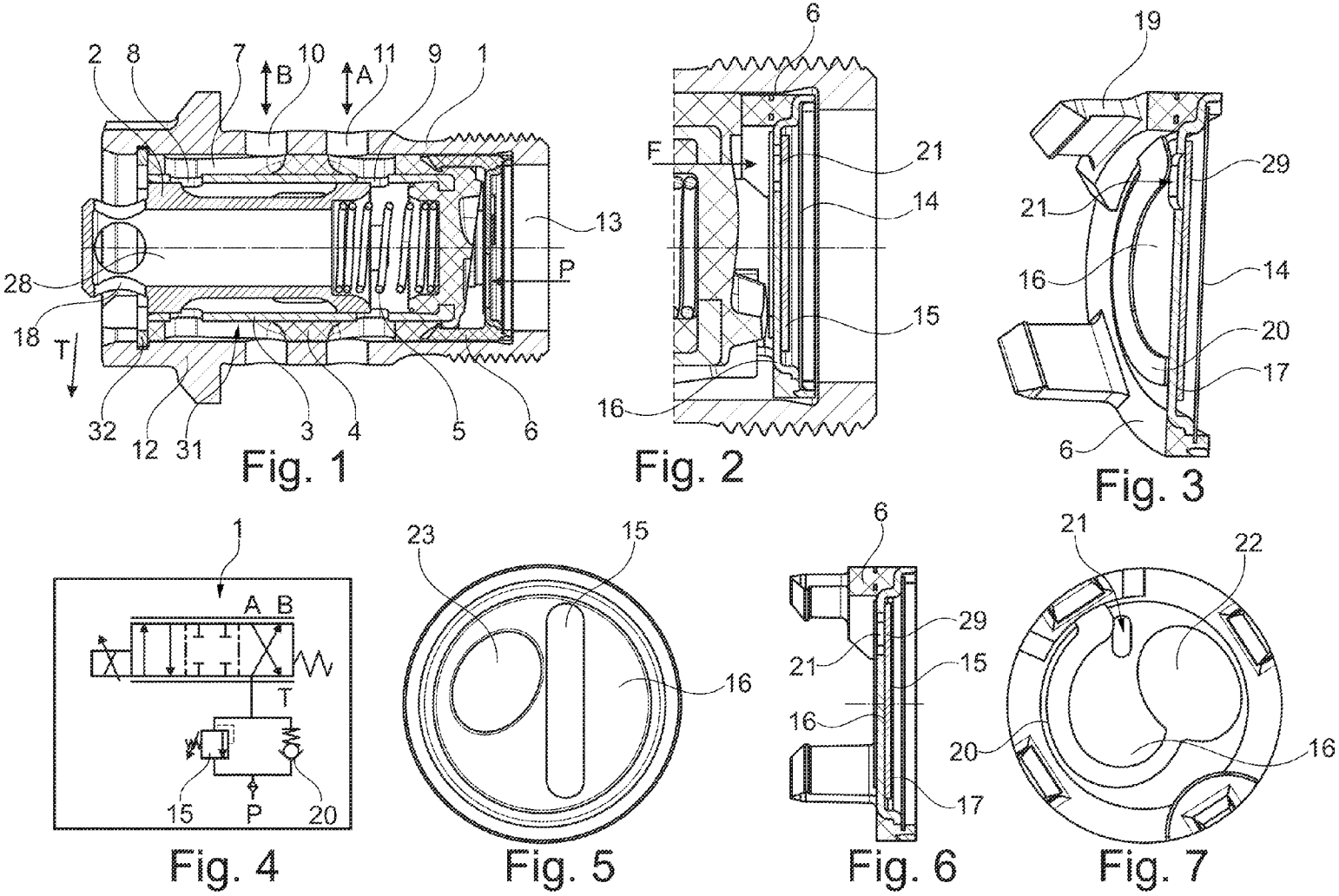
FIG. 1 a central valve for a camshaft adjusting device in cross-sectional representation, FIG. 2 an enlarged partial cross-section of the inlet flow section of the central valve, FIG. 3 an attachment part with a non-return valve and a pressure limiting valve, FIG. 4 a hydraulic circuit diagram of the central valve with the non-return valve and the pressure limiting valve, FIG. 5 the attachment part in a view from the feed side of a pressurized medium fed from a pressurized medium pump, FIG. 6 a cross-sectional representation of the attachment part, FIG. 7 the attachment part in a view from the discharge side of a pressurized medium fed from a pressurized medium pump, FIG. 8 a central valve with a pressure limiting valve in a second embodiment, and FIG. 9 a central valve with a pressure limiting valve in a third embodiment.

In FIG. 1, a central valve 1 according to the invention for a camshaft adjusting device can be seen, wherein this central valve has, on the right side, a feed opening 13 through which the pressurized medium fed from a pressurized medium pump P flows in the direction of the arrow. The pressurized medium is fed in the central valve 1 by a complex system made from pressurized medium lines and control edges into one of the feed and discharge openings 10 or 11 by means of which the pressurized medium for adjusting the rotational angle of a camshaft relative to a crankshaft of the internal combustion engine flows into a group of work chambers A or B, while the pressurized medium from the other group of work chambers A or B flows back via the other feed and discharge openings 10 or 11 and into a pressurized medium reservoir T via the central valve 1. Here, in the camshaft adjusting device there are usually several work chambers A and B with identical functions that are simultaneously loaded with pressurized medium via the feed and discharge openings 10 or 11 and designated as the group of work chambers A or B.

The central valve 1 comprises a central screw 12 in which the feed and discharge openings 10 and 11 are arranged and an insert part 31 locked in movement and rotation in the central screw 12. The insert part 31 is formed by a dimensionally stable guide sleeve 3, e.g., made from steel, and a plastic insert molding 4. In the guide sleeve 3, a valve body 2 is guided displaceably that is supported by means of a spring 5 on a base surface of the plastic insert molding 4, so that the valve body 2 is spring-mounted in the central valve 1 against the push-in direction. The valve body 2 is further secured against slipping out by a locking ring 32 in a position and biased by means of the spring 5. The valve body 2 is provided on its radial outer side with two control edges and a recess provided between the control edges, wherein the control edges form a guide of the valve body 2 in the guide sleeve 3 and the recess forms a section of a pressurized medium line 7 or, expressed differently, a pressure chamber between the valve body 2 and the guide sleeve 3. In the guide sleeve 3 there are several openings 8 and 9 that are closed or opened by the control edges as a function of the position of the valve body 2 and create, in the opened position, a flow connection between the pressurized medium line 7 and the feed and discharge openings 10 and 11. In the guide sleeve 3 and the plastic insert molding 4 there are also other flow channels and openings that cannot be seen and that create a flow connection from the feed opening 13 to the pressurized medium line 7. The valve body 2 also has a central hole 28 that is open on one side and several openings 18 through which the pressurized medium can flow via the feed and discharge openings 10 and 11 from the work chambers A or B into the pressurized medium reservoir T.

The feed opening 13 of the central valve 1 is closed by a closing plate 16 which is part of an attachment part 6 that is shown enlarged in FIG. 2, FIG. 3, FIG. 5, FIG. 6, and FIG. 7. On the attachment part 6 there is a filter 14 that filters out particles from the fed pressurized medium. The attachment part 6 also has a plurality of clamping arms 19 with which it is set on the plastic insert molding 4 of the insert part 31.

In the closing plate 16 there is a non-return valve 20 and a pressure limiting valve 15 that are arranged, as can also be seen in the hydraulic circuit diagram shown in FIG. 4, effectively parallel to each other. This is realized in the present embodiment by the non-return valve 20 and the pressure limiting valve 15 each being formed by passage openings 21 and 23 in the closing plate 16, which are closed by closing parts 22 and 29 arranged on different sides of the closing plate 16. The closing parts 22 and 29 are each the end sections of spring sheets that are held rigidly on the closing plate 16 at one end and are spring-mounted by their shape and mounting in the direction of the closing position closing the passage openings 21 and 23.

For the case that the pressurized medium pump P is activated, a pressurized medium is fed into the feed opening 13, wherein the closing part 22 of the non-return valve 20 is pressed away and the pressurized medium can flow into the central valve 1 through the opened passage opening 23. For the case that pressure spikes that exceed a certain pressure occur in the camshaft adjusting device, the closing part 29 of the pressure limiting valve 15 is pressed away in the same way in the direction of the feed opening 13, so that the pressurized medium can exit through the passage opening 21 in the direction of arrow F (see FIG. 2) to the pressurized medium pump P. Because it is possible to reduce the pressure spikes, the loading of the parts in the camshaft adjusting device and in the central valve 1 and especially the plastic parts located therein can be reduced, which can also reduce the likelihood of damage to the entire camshaft adjusting device.

The pressure limiting valve 15 is constructed in the present embodiment as an elongated spring sheet that is held rigidly on the closing plate 16 at one end in a connecting point 17 and closes with the other end forming the closing part 29 the passage opening 21 in a spring-biased way. The non-return valve 20 is constructed identically in principle and is arranged on the other side of the closing plate 16, so that the effective directions of the pressure limiting valve 15 and the non-return valve 20 are opposite each other, and, in particular, a return flow of the pressurized medium via the pressure limiting valve 15 is also possible for a closed non-return valve 20. Through the parallel acting arrangement of the pressure limiting valve 15, the non-return valve 20 can be bridged practically with the use of the same pressurized medium lines, wherein the only necessary structural changes relative to the previously conventional central valve 1 can be seen in that the passage opening 21 and the closing part 29 of the pressure limiting valve 15 must be arranged on the closing plate 16.

Figure 8:
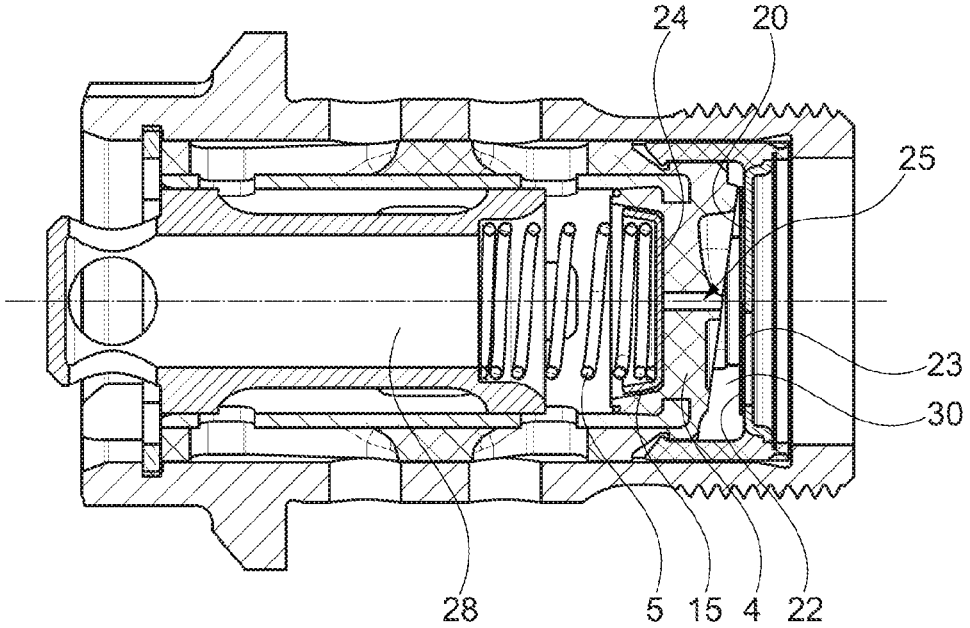

In FIG. 8, an alternative embodiment of the invention can be seen in which the pressure limiting valve 15 is formed by a passage opening 25 in the base surface of the plastic insert molding 4 of the insert part 31 and a closing plate 24 by means of which the spring 5 is supported on the base surface and closes the flow opening 25. The base surface of the plastic insert molding 4 forms a partition wall that separates a section 30 of the pressurized medium line between the non-return valve 20 and the feed and discharge openings 10 and 11 from the hole 28 in the valve body 2. If pressure spikes occur in the camshaft adjusting device, as described above, the closing plate 24 is shifted to the left in the figure against the spring force of the spring 5 so that the flow opening 25 is opened and the pressurized medium can be discharged via the hole 28 of the valve body 2 directly into the pressurized medium reservoir T.

Figure 9:
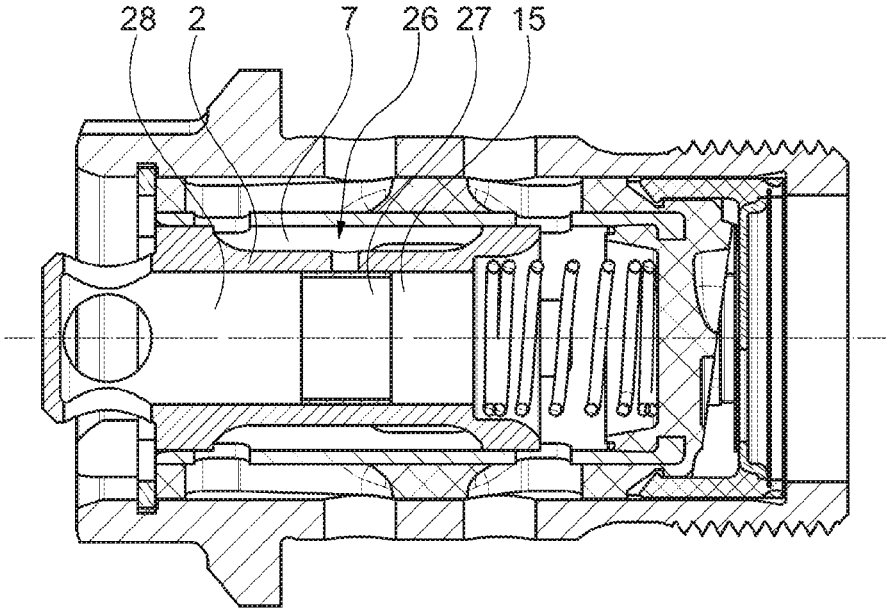

In FIG. 9, another alternative embodiment of the invention is shown in which the pressure limiting valve 15 is formed by a flow opening 26 in the recess of the valve body 2 and a ring sleeve 27 closing the flow opening 26 radially on the inner side. The valve body 2 forms, in the section in which the flow opening 26 is arranged, a partition wall between the hole 28 and the pressurized medium line 7, so that the pressurized medium can also flow directly into the pressurized medium reservoir T via the hole 28 from the pressurized medium line 7 when pressure spikes occur.

LIST OF REFERENCE NUMBERS

1 Central valve
2 Valve body
3 Guide sleeve
4 Plastic insert molding
5 Spring
6 Attachment part
7 Pressurized medium line
8 Opening
9 Opening
10 Feed and discharge opening
11 Feed and discharge opening
12 Central screw
13 Feed opening
14 Filter
15 Pressure limiting valve
16 Closing plate
17 Connecting point
18 Opening
19 Clamping arms
20 Non-return valve
21 Flow opening
22 Closing part
23 Passage opening
24 Closing plate
25 Flow opening
26 Flow opening
27 Ring sleeve
28 Hole
29 Closing part
30 Pressurized medium line
31 Insert part
32 Locking ring

The invention claimed is:

1. A camshaft adjusting device for an internal combustion engine comprising:

a rotor that is lockable in rotation with a camshaft of the internal combustion engine, and a pot-shaped stator that is drivable by a crankshaft and encompasses the rotor, and an annular space present between the stator and the rotor and divided into several pressure chambers by stator ribs extending up to the rotor, wherein the pressure chambers are each divided by vanes provided on the rotor into two work chambers (A, B), and a central valve with a displaceable valve body by which a pressurized medium fed out from a pressurized medium reservoir (T) via a pressurized medium pump (P) is selectively fed into the work chambers (A, B) on one side of the vane as a function of a position of the displaceable valve body and is returned from the work chambers (A, B) into the pressurized medium reservoir (T) on the other side of the vane, and a pressure limiting valve in the camshaft adjusting device that enables a return of the pressurized medium back into the pressurized medium reservoir (T) or to the pressurized medium pump (P) when a predetermined pressure in the camshaft adjusting device is exceeded.

2. The camshaft adjusting device according to claim 1, wherein on the camshaft adjusting device, a non-return valve is provided, by which the pressurized medium fed from the pressurized medium pump (P) is fed into the camshaft adjusting device, and the pressure limiting valve is arranged effectively parallel to the non-return valve.

3. The camshaft adjusting device according to claim 2, wherein the non-return valve comprises a first flow opening that is closable by a first closing part against a feed direction of the pressurized medium from the pressurized medium pump (P), and the pressure limiting valve comprises a second flow opening that enables a return flow of the pressurized medium bypassing the non-return valve and is closed by a second closing part that automatically opens the second flow opening when a predetermined pressure is exceeded in the camshaft adjusting device, the first and second flow openings are arranged in a plate closing a feed opening in the central valve, and the first closing part and the second closing part are each formed by spring sheets closing the flow openings on different sides of the plate.

4. The camshaft adjusting device according to claim 1, wherein the pressure limiting valve is arranged in a partition wall of the central valve or the displaceable valve body that separates a pressurized medium line leading toward the work chambers (A, B) from a pressurized medium line leading toward the pressurized medium reservoir (T).

5. The camshaft adjusting device according to claim 4, wherein the displaceable valve body has a pipe section that forms a section of the pressurized medium line leading toward the pressurized medium reservoir (T) and the pressurized medium flowing to the work chambers (A, B) flows around an outside said pipe section, and the pressure limiting device is formed by an opening in the pipe section that is closed on a radial inner side of the pipe section by a ring sleeve.

6. The camshaft adjusting device according to claim 1, wherein the pressure limiting valve is integrated by insert molding with plastic in a plastic part of the camshaft adjusting device.

7. The camshaft adjusting device according to claim 1, wherein between the displaceable valve body and the central valve there is a spring that is supported on a base surface of the central valve and forces the displaceable valve body into a starting position, and the pressure limiting valve is formed by an opening in the base surface that is closed by a closing plate arranged between the spring and the base surface.

8. A central valve for a camshaft adjusting device comprising:

a displaceable valve body, wherein a pressurized medium fed from a pressurized medium reservoir (T) via a pressurized medium pump (P) is selectively fed into different work chambers (A, B) of the camshaft adjusting device as a function of the position of the displaceable valve body and is returnable into the pressurized medium reservoir (T), and in the central valve there is a pressure limiting valve that enables a return of the pressurized medium back into the pressurized medium reservoir (T) or to the pressurized medium pump (P) when a predetermined pressure of the pressurized medium is exceeded.

* * * * *